US005148555A

United States Patent [19]

Doyle

[11] Patent Number: 5,148,555

[45] Date of Patent: Sep. 22, 1992

[54] CONTROLLABLE WATER-DISPLACEMENT DEVICE

[75] Inventor: Charles E. Doyle, Grand Rapids, Mich.

[73] Assignee: Water Logic, Inc., Grand Rapids, Mich.

[21] Appl. No.: 661,026

[22] Filed: Feb. 25, 1991

[51] Int. Cl.[5] ..... E03D 1/00

[52] U.S. Cl. ..... 4/415

[58] Field of Search ..... 4/324, 325, 415

[56] References Cited

U.S. PATENT DOCUMENTS

| | | | |
|---|---|---|---|
| 2,762,060 | 9/1956 | Jahn | 4/366 X |
| 3,431,564 | 3/1969 | Davies | 4/354 X |
| 3,820,170 | 6/1974 | Kern et al. . | |
| 3,877,081 | 4/1975 | Klein | 4/415 |
| 3,946,447 | 3/1976 | Moon . | |
| 4,044,407 | 8/1977 | Silcox | 4/325 |
| 4,121,308 | 10/1978 | Raab | 4/415 |
| 4,143,430 | 3/1979 | Joshi et al. | 4/415 X |
| 4,152,793 | 5/1979 | Mills | 4/415 X |
| 4,250,579 | 2/1981 | Moon | 4/415 |
| 4,388,737 | 6/1983 | Wenzel | 4/415 |
| 4,543,674 | 10/1985 | David | 4/415 |

*Primary Examiner*—Charles E. Phillips
*Attorney, Agent, or Firm*—Waters & Morse

[57] ABSTRACT

A selectively controlled displacement container is insertible in a standard toilet flush tank. The bottom of a container has a discharge-fill opening, and the top has an air inlet controlled by a selectively activated air inlet valve. Opening this valve adds the contents of the container to that of the surrounding tank. The valve can be restored to closed position by buoyancy forces on the following tank fill.

5 Claims, 4 Drawing Sheets

CONTROLLABLE WATER-DISPLACEMENT DEVICE

BACKGROUND OF THE INVENTION

This invention provides a controllable device for selectively reducing the volume of water discharged by a flush tank. These tanks are commonly associated with toilets, and have a total capacity of anywhere from 2½ to 9 gallons of water. This quantity is usually discharged at each flushing, in the standard installation. Three considerations have emerged that make it desirable to selectively limit the flushing volume. One of these is the cost of water, and another is the environmental necessity for water conservation. The latter problem is so acute in some areas of the country that laws regulating water consumption have either been passed, or are under consideration. Sewage discharge is another problem. Even heavily diluted sewage is still sewage, and must be handled by processing plants, if it is not to be released where it becomes a health hazard.

Toilet usage involves the disposal of liquid waste about six times as often as it does solid waste. The volume of water required to flush the liquid properly is a small fraction of the quantity required to clear out the solid material. The system must be capable of handling both. Fixed displacement devices, like a masonry brick placed in the flush tank, somewhat reduce the volume, but must be manually removed when a full flush is desired. This is an obvious nuisance. Immersible containers have also been placed in flush tanks, and partition arrangements have been used to divide the tank into compartments having outlet valves that can be selectively operated.

A very practical problem that has limited the acceptance of these arrangements is the requirement for special tank designs, or special actuating mechanisms. Either of these makes it difficult or impractical to incorporate the system into conventional existing installations.

SUMMARY OF THE INVENTION

This invention proposes a displacement container insertible in a standard flush tank without modification of the tank. The container has an open discharge opening at the bottom through which the container is also filled by the normal fill cycle after it has been dumped. The container is otherwise closed, except for an air inlet opening at the top. The standard float valve system establishes a maximum tank level that preferably covers the container, including the air inlet. An air control valve normally seals this air inlet, but can be opened to dump the contents of the container to add its capacity to that of the tank when needed. As the water level rises above the container, the preferred form of the invention has a buoyancy chamber on the air control valve that rocks it back to closed position automatically.

DESCRIPTION OF THE PREFERRED EMBODIMENTS

Figure 2:
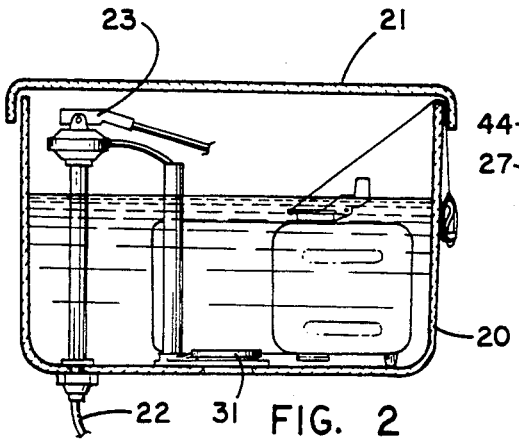
FIG. 2 is a sectional elevation of the tank assembly, showing the filled position of the tank established by the float valve mechanism.

Referring to FIGS. 1–4, the standard toilet flush tank 20 has a cover 21, and a fill system including the supply conduit 22 and the float valve 23. The float itself is shown in dotted lines at 24 in FIG. 1, and is mounted at the outer extremity of the arm 25. The toilet 26, and its association with the tank 20, are conventional.

In a conventional flush tank installation, the entire contents of the tank 20 are dumped every time the operating handle 27 is actuated. The present invention centers in the presence of a container 28, which is immersed in the tank 20 to displace a gallon to a gallon and a half of the volume that would otherwise be available in the tank. The container 28 preferably has an L-shaped configuration adapted to make use of the available space within the standard tank installation. The container 28 has legs as shown at 29 and 30 in FIG. 4 to support it a short distance above the bottom 31 of the tank 20. A discharge opening 32 is formed in the bottom 33 of the container 2, which remains open during the operation of the system. When the air valve assembly generally indicated at 34 is actuated, the contents of the container 28 is dumped out through the opening 32 to be added to the contents of the surrounding tank 20 for a full flushing operation.

Figure 1:
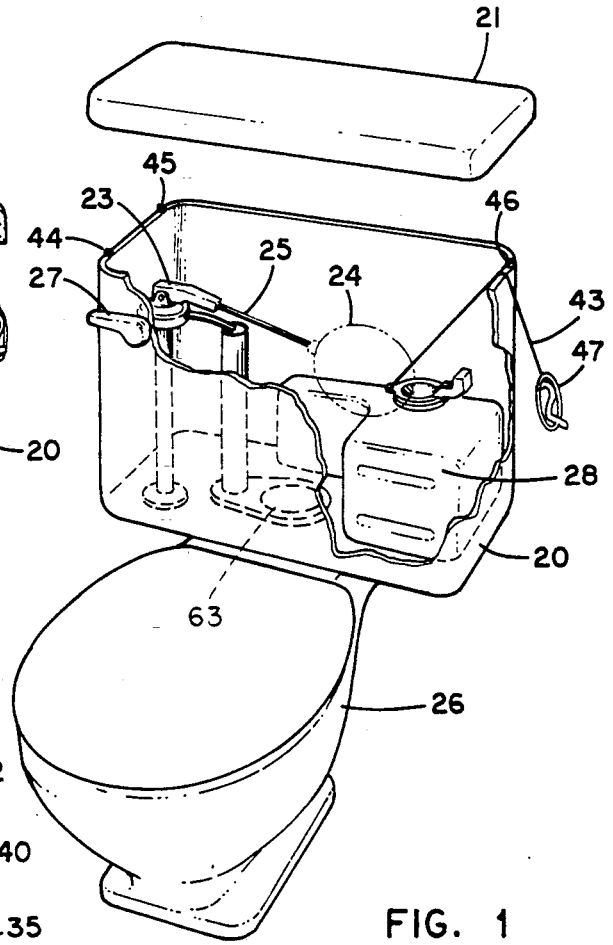
FIG. 1 is a perspective view showing a standard flush tank and toilet installation, with a portion of the tank broken away to show the position of the displacement device.
Figure 3:
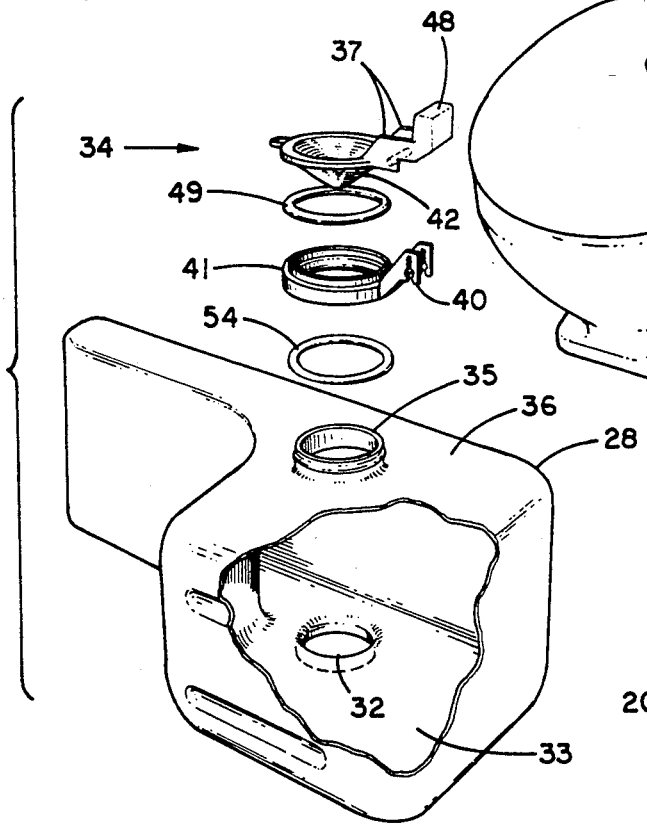
FIG. 3 is an exploded view showing the details of the variable displacement device and its air valve.
Figure 4:
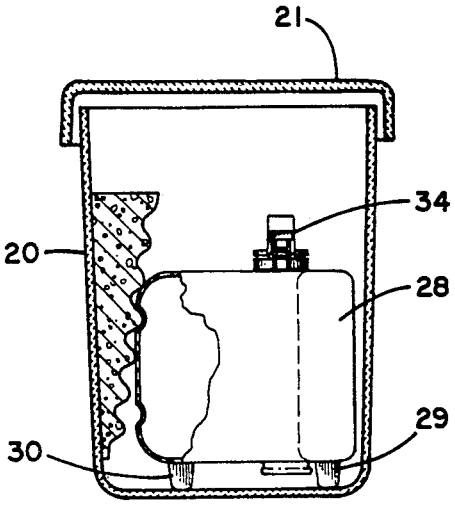
FIG. 4 is a sectional elevation on a plane perpendicular to that of FIG. 2.

The air valve assembly 34 normally closes the air inlet opening 35 in the top 36 of the container. The construction and operation of the air valve assembly are best shown in FIGS. 8–12. The air valve member generally indicated at 34 has a central arm 37 provided with a fulcrum pin as indicated at 38. Slots 39 of the pivot bracket 40 formed integrally with the ring 41 provide resilience permitting the slots to be expanded to admit the pin 38 into a wider portion of the slots which act as bearings for the pin 38. The ring is received over the neck of the container that forms the air inlet 35. At the left end of the arm 37, as viewed in FIGS. 8–10, a conical closure 42 is positioned so that rotation of the valve member 34 in a counterclockwise direction will place the closure 42 in the FIG. 8 position where at it effectively seals off the air inlet 35. The closure 42 is concave upward, so that it forms a container for a small quantity of water, when it is in the FIG. 8 position. Actuation of the valve to open the air inlet 35 is accomplished by pulling on the cord 43, which rotates the valve to the FIG. 9 position, and spills out the water previously impounded in the FIG. 8 position. The cord 43 extends out over the edge of the tank 20 at the end, as shown in FIG. 1. The top edge of the tank 20 is provided with spacer buttons as shown at 44–46 in FIG. 1 to elevate the top 21, and provide a somewhat resilient cushion for the top so that it does not rock when it is installed. These buttons are conventional. They provide enough space between the top and the upper edge of the tank 20 for the passage of the cord 43, which slides over the edge of the tank as the handle 47 is pulled when a full flush of the tank 20 is desired.

Figure 10:
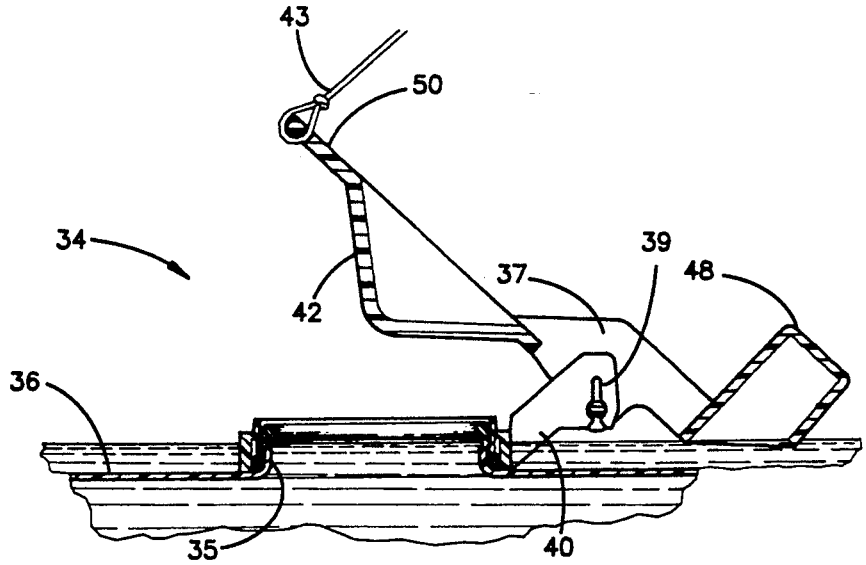
FIG. 10 illustrates the position of the components of the air valve as the tank is approaching the full depth established by the float valve assembly.
Figure 11:
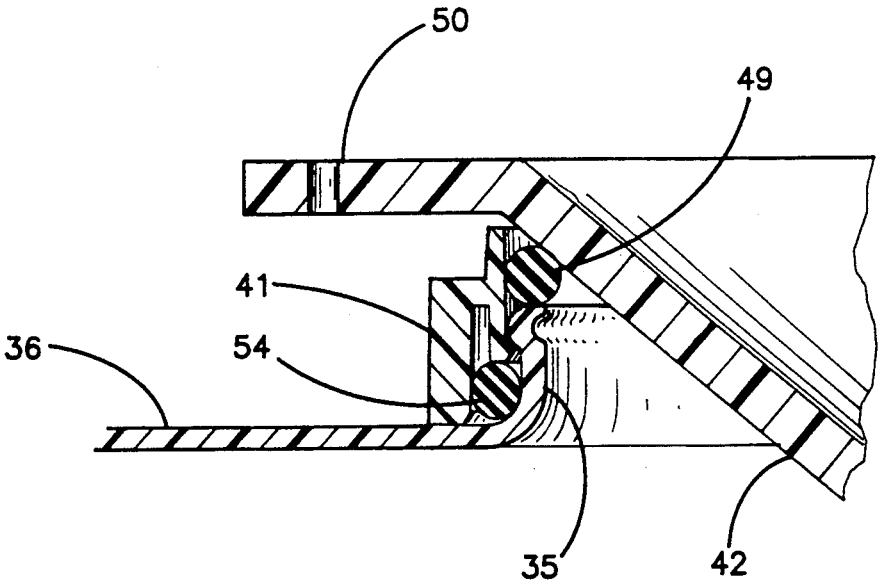
FIG. 11 is a section on an enlarged scale over that of FIGS. 8–10, and illustrating a possible construction of the air inlet opening.
Figure 12:
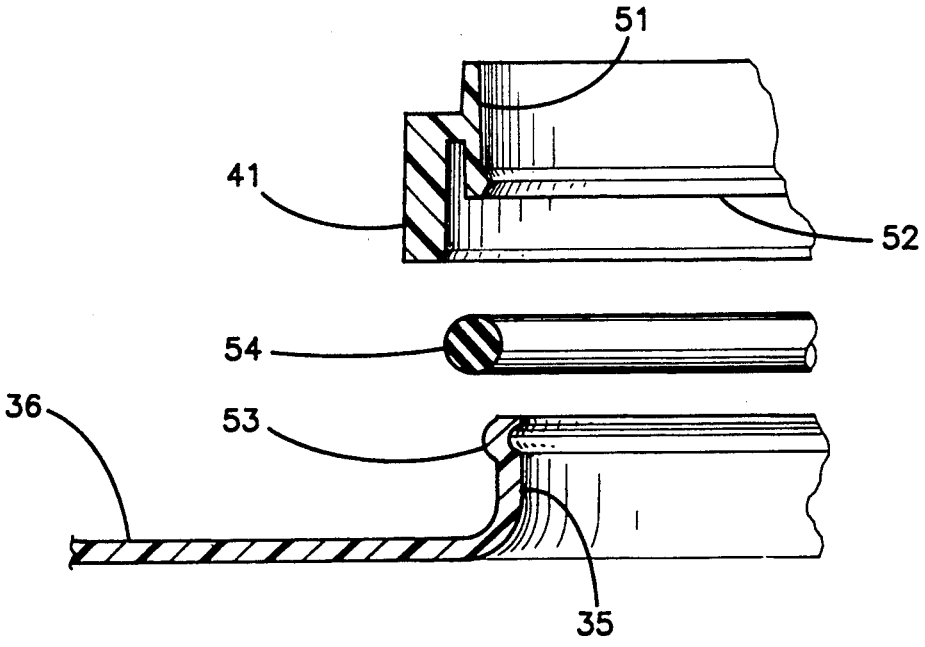
FIG. 12 is an exploded view of the components illustrated in FIG. 11, but without the upper O-ring.

The opposite end of the arm 37 carries a downwardly-open buoyancy chamber 48. When this chamber is immersed in water, it provides an upward force tending to rock the valve member 34 in a counterclockwise direction to return the closure 42 to the FIG. 8 position. FIG. 10 illustrates the beginning of this condition, as the level of the water reaches approximately the top of the air inlet opening 35. As the water level continues above this point to the condition shown in FIG. 2, the counterclockwise rotation will have been completed, and the cord 43 pulled back along with it. The water level by this time will be over the edge of the closure 42, and will re-fill the conical depression. In the condition shown in FIG. 8, the water contained within the closure 42 provides an added downward force contributing to the seal of the conical closure against the O-ring 49 carried by the ring 41. The entire valve member 34, including the terminal 50 for the cord 43, is preferably molded from a plastic material suitable to the conditions under which the device is expected to operate. The sealing O-ring 49 is received in the ring 41 as shown in FIG. 11, which also has a resilient flange 52 capable of a slight degree of radially outward deflection to provide a snap-in assembly over the annular ridge 53 at the upper end of the neck forming the air inlet 35. This ridge also engages the ring 49. The lower O-ring 54 may be slipped over the neck of the air inlet, as shown in FIG. 11, to supplement the seal between the ring 41 and the air inlet, but the snap-in relationship at the flange 52, and the effect of the O-ring 49, may make the lower O-ring 54 unnecessary. The upper O-ring 49, however, should be of very soft material so that the relatively light forces involved in the positioning of the air valve 34 would be sufficient to make the seal at this point effective. An O-ring of sponge material, or tubular in cross section, will increase the capability of the O-ring to accommodate itself to the slight changes in position of the valve.

Figure 5:
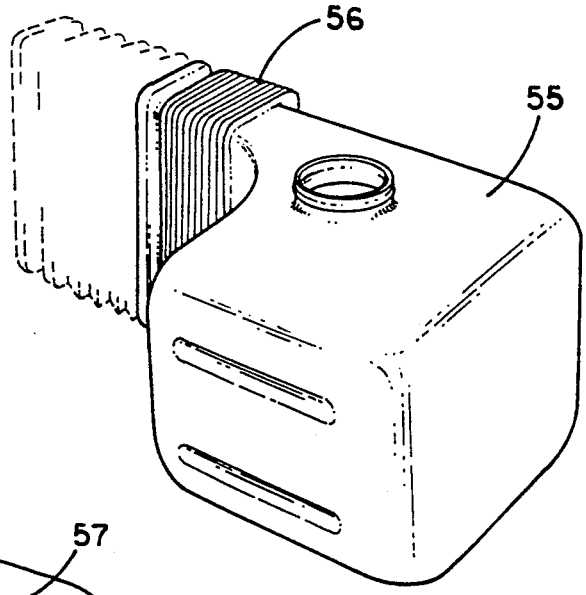
FIG. 5 is a perspective view showing a form of the displacement container in which a section of it is expandable to suit the accommodation of a particular tank.
Figure 6:
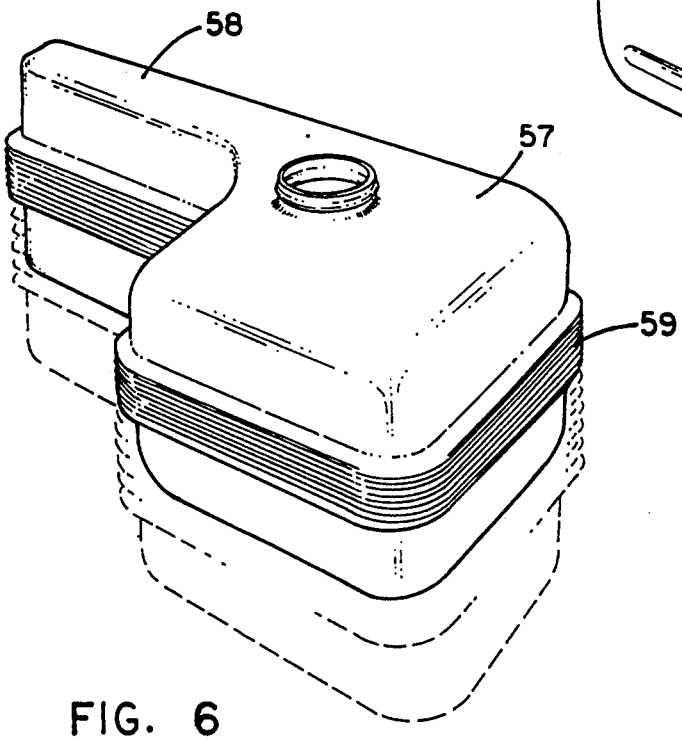
FIG. 6 is a perspective view of a modified form of the displacement container, illustrating a different direction of expandability.
Figure 7:
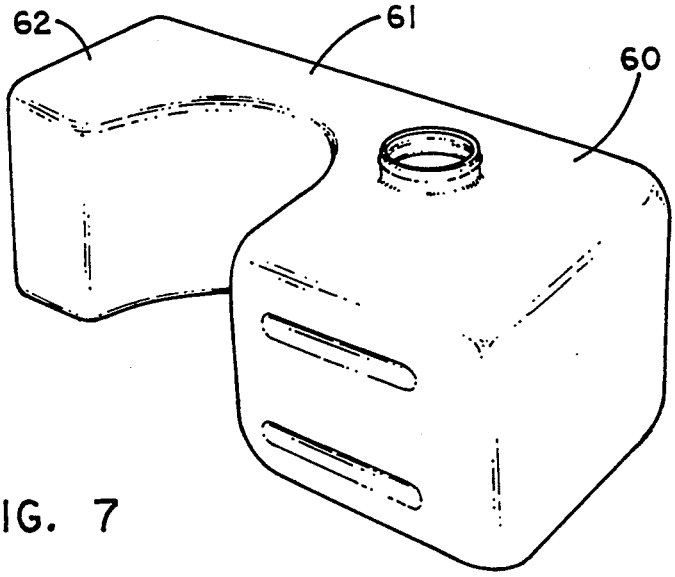
FIG. 7 illustrates a further modification of the displacement container using space available at various portions of the tank, but without the capability of expansion.
Figure 8:
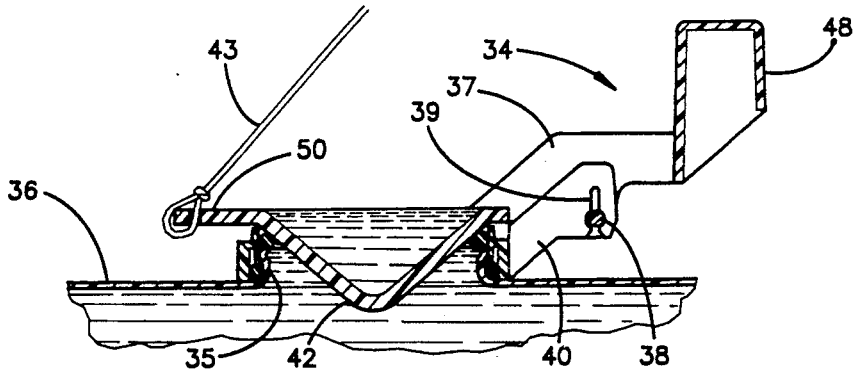
FIG. 8 is a section on an enlarged scale showing the air valve assembly, in a position corresponding to that in which the main tank has been flushed, but the displacement container has not been actuated to add its contents to the flushing volume.
Figure 9:
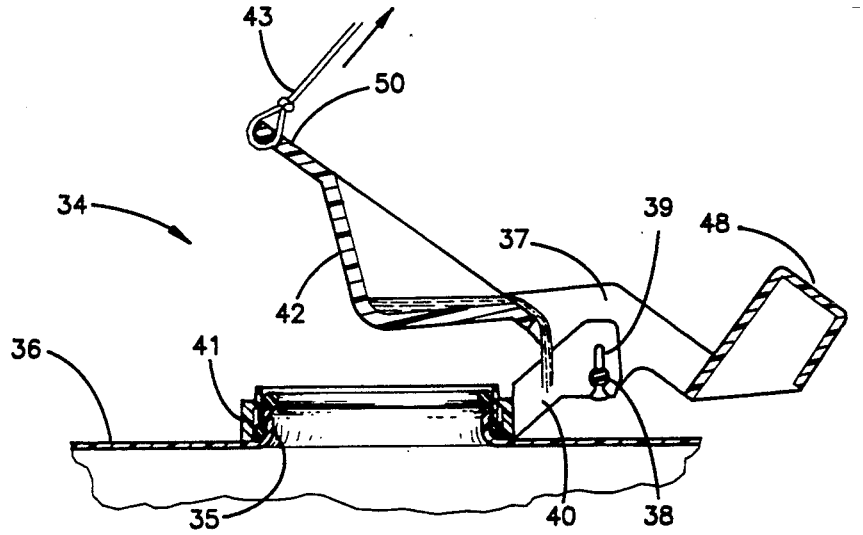
FIG. 9 is a section of the same mechanism as that illustrated in FIG. 8, in position which would result after the air valve has been actuated to deliver the contents of the container to that of the surrounding tank.

Referring to FIGS. 5–7, three different container configurations are illustrated which may be used to suit various tank installations. In FIG. 5, the large lobe 55 of the container has a lateral extension 56 with an accordion-pleated portion permitting extension to the dotted line position to reach the end of the tank to provide the largest capacity for the container within the available space. In FIG. 6, the main lobe 57 and the lateral extension 58 are both provided with an accordion-pleated section 59 to provide vertical expansion for the optimum utilization of space. In FIG. 7, the main lobe 60 and the lateral extension 61 are not expandable, but the extension 61 terminates in the auxiliary lobe 62, which can be dimensioned to suit particular tanks. The main portions of the container, and the extended portions as well, may be adhesively bonded to the tank wall, if desired, to secure the relative position of the container and tank. It is important that the space within the tank be utilized without interfering with the movement of the conventional dump valve 63 shown in FIG. 1. The bottom of the discharge opening 32 should be just below the minimum water level in the tank established by the dump valve 63.

I claim:

1. A variable displacement device for a flush tank, said device comprising:

a container having an exhaust opening in a lower portion and also an air inlet opening in an upper portion thereof;

closure means for sealing said inlet opening against the passage of said closure means being movable between positions opening and closing said inlet opening, said closure means being a rockable member having a closure portion at one extremity thereof, and a downwardly-open buoyancy chamber at the opposite end thereof, said container having fulcrum means between said closure portion and said buoyancy chamber for pivotally supporting said member thereon; and actuating means adapted to open said closure means.

2. A device as defined in claim 1, wherein said closure portion is upwardly concave.

3. In combination with a flush tank having a bottom and a dump valve, and also fill means including float controlled valve means adapted to establish a maximum liquid level in said tank, a displacement device comprising:

a container within said tank, said container having an exhaust opening adjacent a bottom thereof, and an air inlet opening adjacent a top thereof;

closure means for sealing said inlet opening against the passage of said closure means being movable between positions opening and closing said inlet opening, said closure means being a rockable member having a closure portion at one extremity thereof, and a downwardly-open buoyancy chamber at the opposite end thereof, said container having fulcrum means between said closure portion and said buoyancy chamber for pivotally supporting said member thereon; and actuating means adapted to open said closure means.

4. A combination as defined in claim 3, wherein said float controlled valve means establishes a maximum water level above said air inlet opening.

5. A combination as defined in claim 4, wherein said closure portion is upwardly concave.

* * * * *

UNITED STATES PATENT AND TRADEMARK OFFICE

CERTIFICATE OF CORRECTION

PATENT NO. : 5,148,555

DATED : September 22, 1992

INVENTOR(S) : Charlie Doyle

It is certified that error appears in the above-indentified patent and that said Letters Patent is hereby corrected as shown below:

Col. 2, line 52, "container 2" should be --container 28--

Signed and Sealed this

Seventh Day of September, 1993

Bruce Lehman

*Attest:*

BRUCE LEHMAN

*Attesting Officer*

*Commissioner of Patents and Trademarks*